US007694355B2

(12) United States Patent
Lo

(10) Patent No.: US 7,694,355 B2
(45) Date of Patent: Apr. 13, 2010

(54) PRESSURE VESSEL

(75) Inventor: Tsung-Yi Lo, Taichung (TW)

(73) Assignee: Globe Union Industrial Corp. (GUIC), Taichung (TW)

( * ) Notice: Subject to any disclaimer, the term of this patent is extended or adjusted under 35 U.S.C. 154(b) by 1076 days.

(21) Appl. No.: 11/366,574

(22) Filed: Mar. 3, 2006

(65) Prior Publication Data

US 2007/0204392 A1 Sep. 6, 2007

(51) Int. Cl.
*E03D 3/10* (2006.01)

(52) U.S. Cl. ..... 4/354

(58) Field of Classification Search ..... 4/354, 4/362, 361, 359, 360
See application file for complete search history.

(56) References Cited

U.S. PATENT DOCUMENTS 4,233,698 A * 11/1980 Martin ..... 4/354
4,984,311 A * 1/1991 Basile et al. ..... 4/354
5,005,226 A * 4/1991 Basile et al. ..... 4/354
5,046,201 A * 9/1991 Steinhardt et al. ..... 4/354
5,153,019 A * 10/1992 Hammond ..... 426/590
6,029,287 A * 2/2000 Ge et al. ..... 4/354
7,010,816 B2 * 3/2006 Li ..... 4/354
7,299,508 B2 * 11/2007 Li ..... 4/354
2004/0194200 A1 * 10/2004 Li ..... 4/354

* cited by examiner

*Primary Examiner*—Khoa D Huynh
(74) *Attorney, Agent, or Firm*—Ming Chow; Sinorica, LLC

(57) ABSTRACT

A pressure vessel at least includes a main vessel, an air entry valve, a water entry valve, a drain valve and a control valve. The drain valve is provided with a valve base set on the top of the main vessel, a piston unit inserted inside the valve base able to be moved upwards and a spring installed between the piston member and the valve base. In addition, the pressured water in the main vessel coming from the water entry valve and the air entry valve can be stored in the control valve and guided to a chamber between the piston unit and the valve base, enabling the piston member to surpasses the elasticity and the water pressure to move up to separate from a drain exit of the main vessel for flushing a toilet. Therefore, the present invention has a simple structure, easy to assemble, preventing accidental flushing.

14 Claims, 16 Drawing Sheets

PRESSURE VESSEL

BACKGROUND OF THE INVENTION

1. Field of the Invention

This invention relates to a pressure vessel for a toilet, particularly to one that able to guide pressured water into a drain valve so as to open it for flushing the toilet.

2. Description of the Prior Art

Commonly, a conventional vessel used for a toilet to carry out flushing is based on gravity force and water level drop, which, actually, are not strong enough to flush down, always needing more water to clean up the toilet, causing a waste of water. In order to be more economic, a pressure vessel has been invented to overcome such a disadvantage. The pressure vessel is mainly installed with an airtight vessel inside it, provided with a drain valve. When water flows into the airtight vessel, air in the airtight vessel is to be compressed to store up some pressure energy that is to strongly enhance extra force, plus the gravity force and the water level drop, to obtain more complete and cleaner flushing when the piston of the drain valve is raised up to keep a water exit opened for releasing the pressurized water in the pressure vessel, able to achieve a good flushing effect with even less water. Such a pressure vessel is disclosed in a U.S. Pat. No. 4,233,698 that includes an airtight vessel, an air and water entry device, a drain valve, a controlling valve and a water entry valve for supplying a pressure for the drain valve. The conventional pressure vessel has still disadvantages as described below.

1. The moment when the drain valve is opened, water in the drain valve to be rushed down is still too less to carry out flushing.

2. If water in the drain valve is to be dropped down for washing, a pressing device on the top has to be pressed down to enable the drain valve to open. In practice, it needs a considerable force to press down the pressing device initially because a strong rebounding force possessed by a compressed spring in the drain valve must be surpassed, inconvenient for operation.

Next, another pressure auxiliary double flushing system disclosed in a U.S. patent No. 2004/0194200 can, though, solve the disadvantages mentioned above, it has a very complicated structure, difficult for assembly and having a high cost. Relatively, it has a higher possibility of breakdown. Also, the pressure vessel of the pressure auxiliary double washing system is to be filled with water until the water exit of the drain valve is completely sealed by a piston in the pressure vessel pressed down by the pressured water rushing into the drain valve. So, it is to take a longer time, about 10 seconds, than a regular pressure vessel for refilling the vessel, having to wait a while for next use. In addition, because the pressure auxiliary double washing system is operated via releasing the pressured water from the drain valve to enforce the piston to move up and disclose the water exit for water to flush down, therefore, the drain valve is as well to move upwards mistakenly to release water if a pressure releasing tube communicated with the drain valve is damaged or leaking, possible to cause a waste of water source.

SUMMARY OF THE INVENTION

The prime object of this invention is to offer a pressure vessel for a toilet.

The main characteristics of the invention are a main vessel, an air entry valve, a water entry valve, a drain valve and a control valve. The drain valve is provided with a valve base set on the top of the main vessel, a piston unit inserted inside the valve base able to be moved upwards and a spring installed between the piston unit and the valve base. In addition, the pressured water in the main vessel coming from the water entry valve and the air entry valve can be stored in the control valve and guided to a chamber formed between the piston unit and the valve base, via controlling the control valve, enabling the piston unit to surpass the elastic force and the water pressure so as to move up to separate from a drain exit of the main vessel for flushing a toilet.

The present invention, based on guiding water to force the piston member to move upwards for separating from the drain exit, has a simpler structure than that of a conventional one based on releasing pressure, able to achieve a quick assembly and a lower cost of manufacturing. Moreover, even if the tube guiding the pressured water is damaged or leaking, the drain exit is not to be opened by accident for flushing, able to prevent water waste. Therefore, the present invention has effects of saving water, quick refilling water and good clean up.

BRIEF DESCRIPTION OF DRAWINGS

This invention is better understood by referring to the accompanying drawings, wherein.

DETAILED DESCRIPTION OF THE PREFERRED EMBODIMENT

Figure 1:
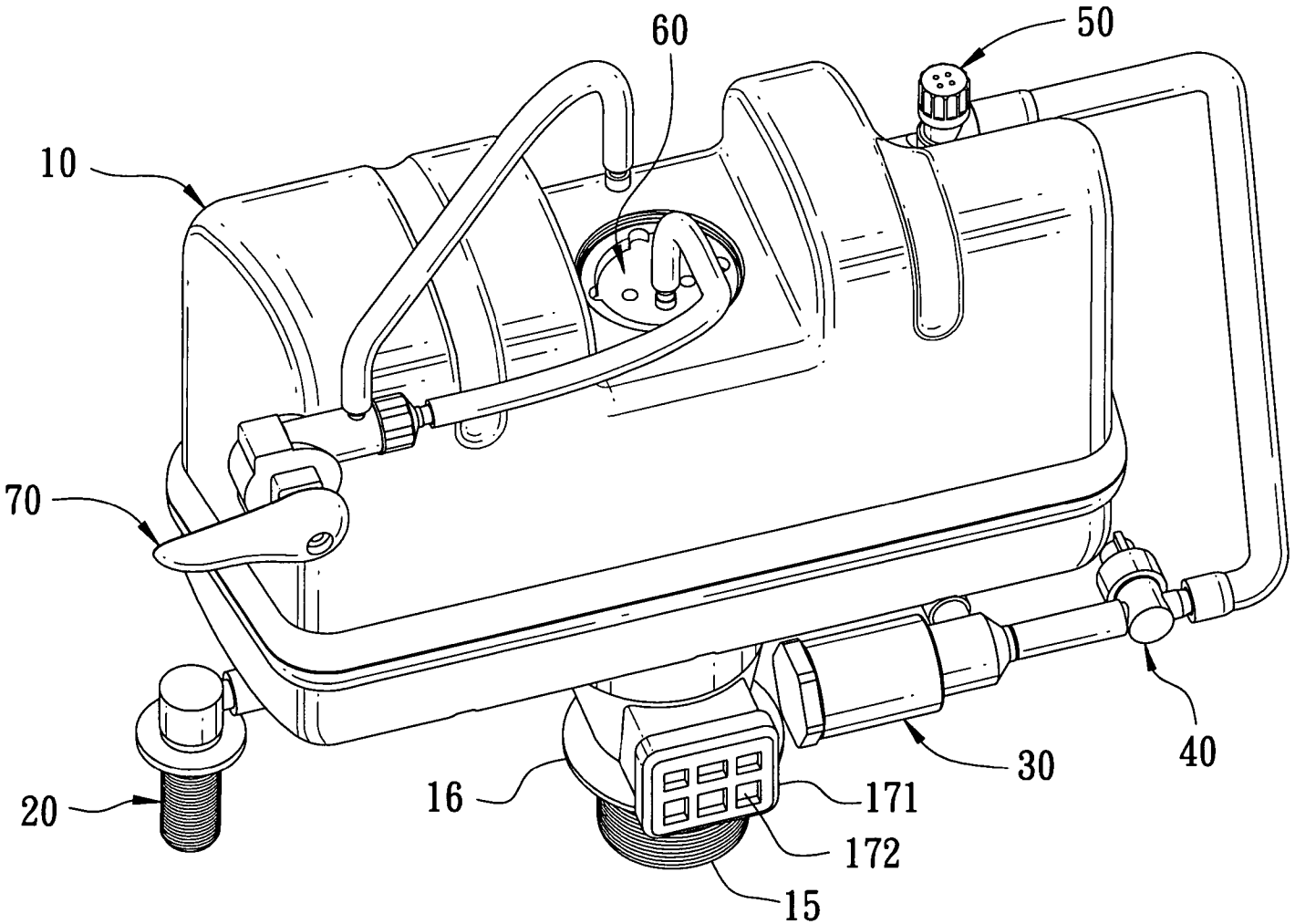
FIG. 1 is a perspective view of a preferred embodiment of a pressure vessel in the present invention.
Figure 2:
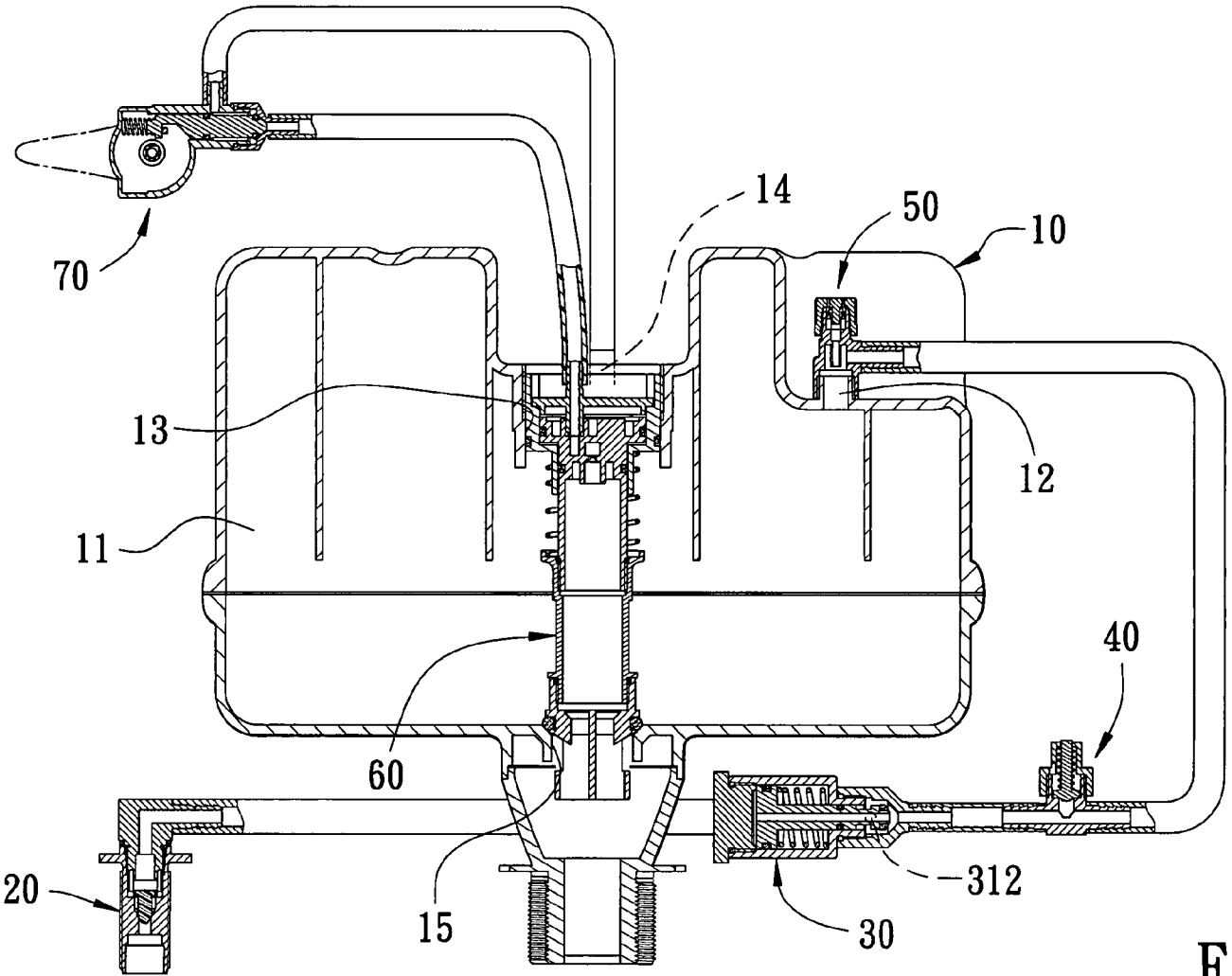
FIG. 2 is a cross-sectional view of the preferred embodiment of a pressure vessel in the present invention.

As shown in FIGS. 1 and 2, a preferred embodiment of a pressure vessel for a toilet in the present invention includes a main vessel 10 installed inside a toilet vessel (not shown in Figures), a water entry valve 20 fixed under the left of the vessel and connected with an inlet tube, a pressure stabilizing valve 30 set behind the water entry valve 20, a pressure releasing valve 40 set behind the pressure stabilizing valve 30, an air entry valve 50 set behind the air entry valve 40 and connected with the main vessel 10 and located at the right upper side of the main vessel 10, a drain valve 60 fixed at the interior center of the main vessel 10 and a control valve 70 fixed at the upper left side of the vessel 10 and connected with the main vessel 10 and the drain valve 60 extending and fixed in the center portion of the main vessel 10.

Figure 3:
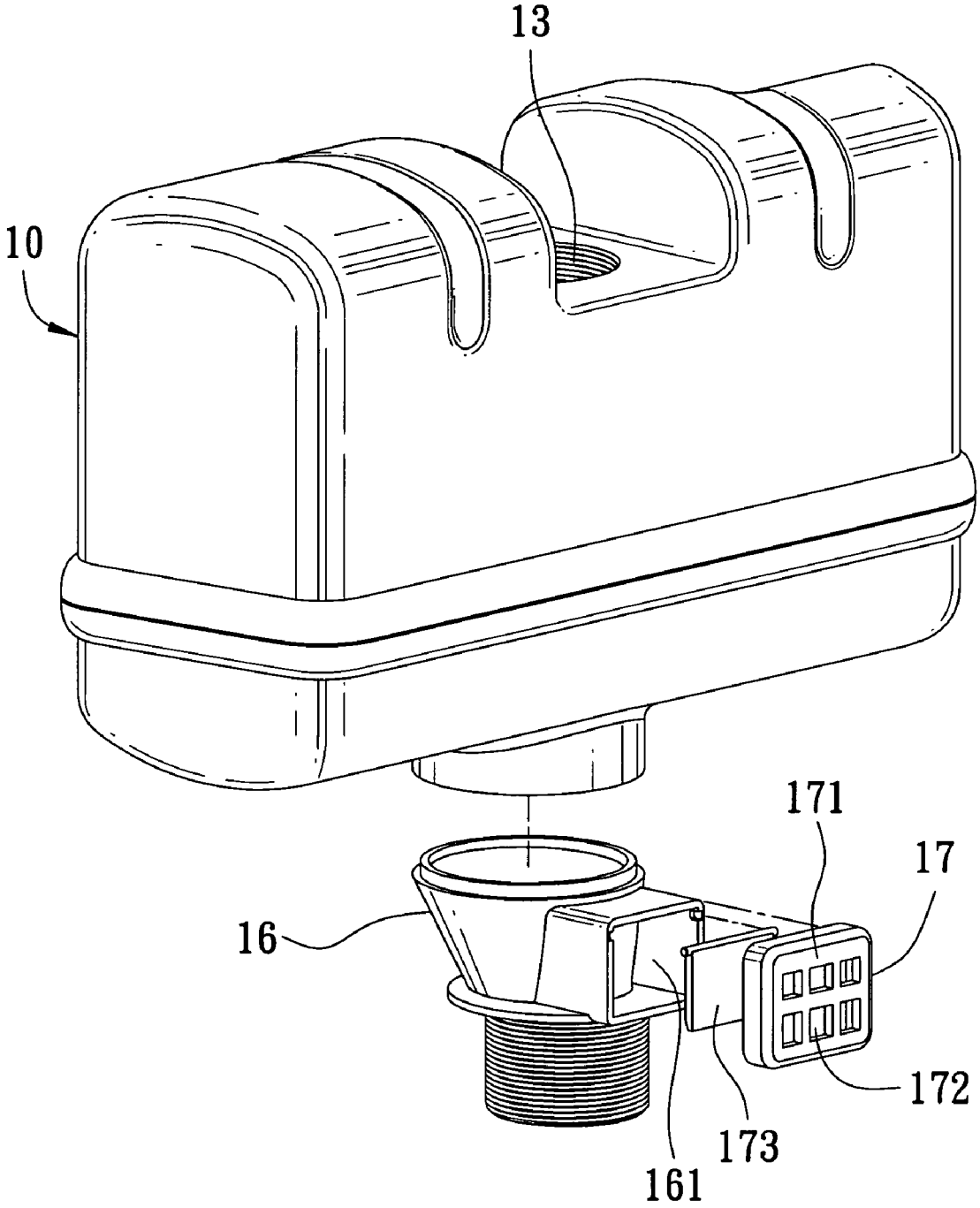
FIG. 3 is a partial exploded perspective view of the preferred embodiment of a pressure vessel in the present invention.

As shown in FIGS. 2 and 3, the main vessel 10 made of a high-strength and stable material is an airtight container provided with a chamber 11 inside it for containing pressured water. The chamber 11 is provided with a water entry 12, an opening 13 and a pressure releasing hole 14 at the upper end properly, and a drain exit 15 at the bottom for releasing pressured water. The drain exit 15 is connected with a threaded base 16 at the bottom, which, linked with the bottom of the vessel for pressured water to wash down, is provided with a opening 161 at the side wall for fitting with a overflow valve 17. The overflow valve 17 is provided with a cover 171 to be covered on the opening 161 of the threaded base, plural overflow holes 172 cut on the cover 171 and an one-way stopper 173 fixed pivotally with the opening 161 inside the cover 171, able to seal the overflow holes 172 inside the cover 171 while being pushed outwards and keep the overflow holes 172 disclosed while being pushed inwards.

Figure 5:
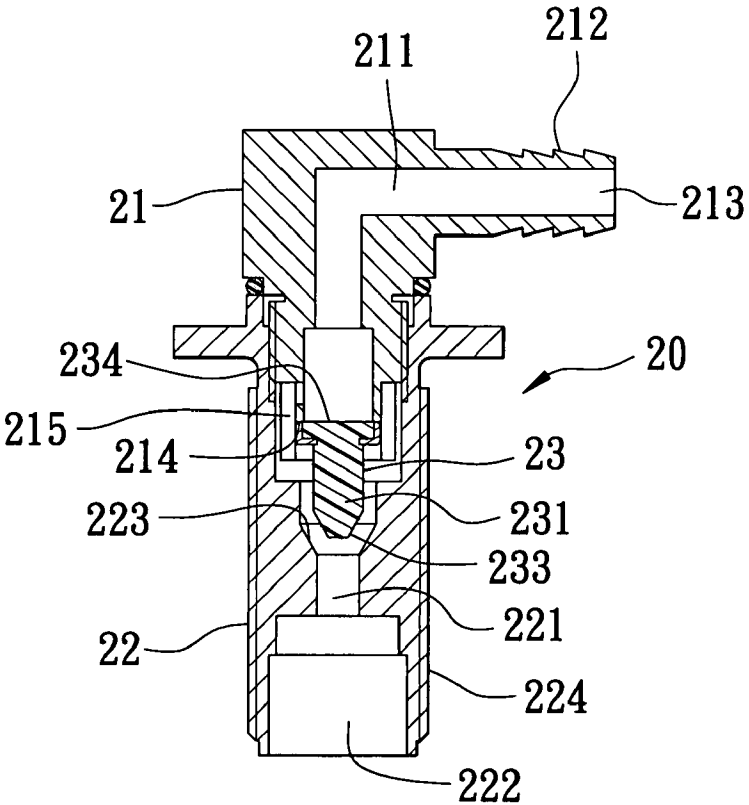
FIG. 5 is a cross-sectional view of the water entry valve of the preferred embodiment of a pressure vessel in the present invention, showing it being assembled.
Figure 4:
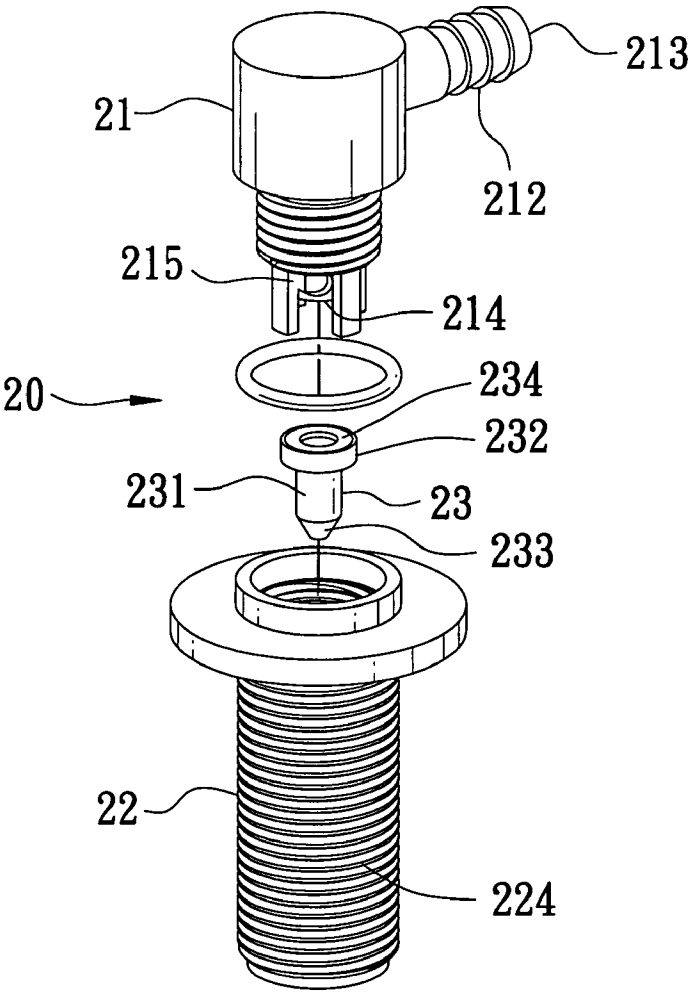
FIG. 4 is an exploded perspective view of a water entry valve of the preferred embodiment of a pressure vessel in the present invention.

The water entry valve 20, as shown in FIGS. 4 and 5, is provided with an upper valve 21, a lower valve 22 screwed fixedly with the upper valve 21 and a movable valve bar 23 installed in the upper valve 21 and the lower valve 22. The upper valve bar 21 is provided with an inner path 211 and a tube connecter 212 at the free end having an exit 213 inside it, communicating with the inner path 211 and the pressure stabilizing valve 30.

The inner path 211 is provided with a fixing groove 214 having a big diameter at the threaded end and plural flow guiding holes 215 interspaced around the annular wall of the threaded end, communicating with the inner path 211 inside the fixing groove 214.

The lower valve 22 is provided with an inner path 221, having an entry 222 at the free end and a funnel hole 223 at the other end, and a male thread 224 threaded around the outer surface for screwing with the vessel.

The movable valve bar 23 is provided with a main body 231 having a head wrapped with a metallic layer 232. The main body 231 made of plastic integrally is provided with a conical member 233 at the end. The metallic layer 232 with a flat surface 234 is able to shift and fit in the fixing groove 214 by a pressure pushing upwards from pressured water, enabling pressured water to flow from the entry 222 of the lower valve 22 through the inner path 221, the funnel hole 223, the flow guiding holes 215, the inner path 211 and the exit 213 orderly. On the contrary, when pressured water flows in reverse, it is to compress the flat surface 234 of the movable valve bar 23 to make the conical member 233 moved downwards until it seals the funnel hole 223.

Figure 6:
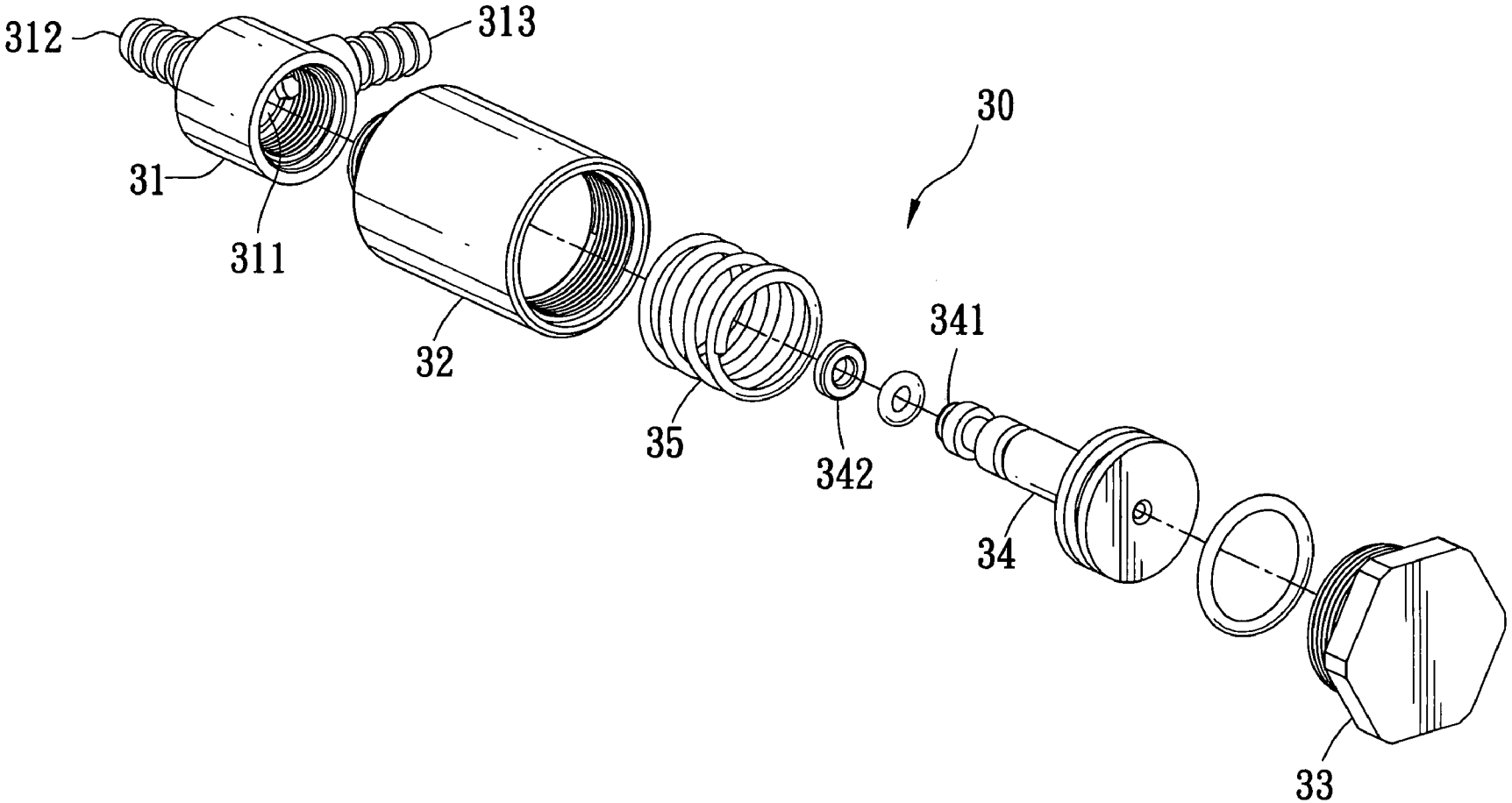
FIG. 6 is an exploded perspective view of a pressure stabilizing valve of the preferred embodiment of a pressure vessel in the present invention.
Figure 7:
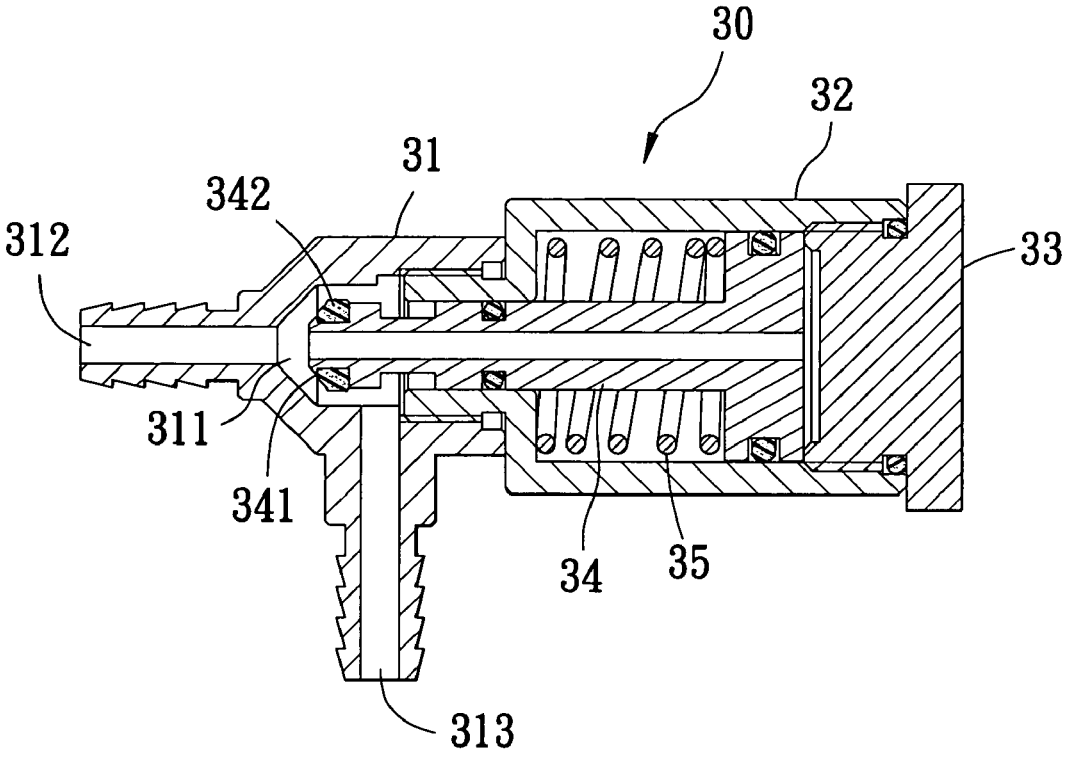
FIG. 7 is a cross-sectional view of the pressure stabilizing valve of the preferred embodiment of a pressure vessel in the present invention.

The pressure stabilizing valve 30, as shown in FIGS. 6 and 7, is provided with a front valve body 31, a rear valve body 32 screwed together with the rear of the front valve body 31, a rear cover 33 screwed together with the rear of the rear valve body 32, a valve rod 34 set inside the front valve body 31 and the rear valve body 32, and a compression spring 35 installed between the rear end of the valve rod 34 and the rear valve body 32. The front valve body 31 is provided with a chamber 311, an exit 312 at one end communicating with the pressure releasing valve 40, and an entry 313 at a side wall communicating with the water entry valve 20. The valve rod 34 is provided with a conical member 341 at the front end, which is provided with a sealer 342 for preventing leaking, and able to be compressed by the compression spring 35 to move backwards so as to come off the exit 312 of the front valve body 31 to keep the exit 312 opened. By the time, when the pressure coming from the entry 313 surpasses a preset pressure, the valve rod 34 is to overtake the expanding force of the compression spring 35 to enable itself to move forwards, so that the sealer 342 in front of the conical member 341 is to close the exit 312, achieving a stabilized pressure.

Figure 9:
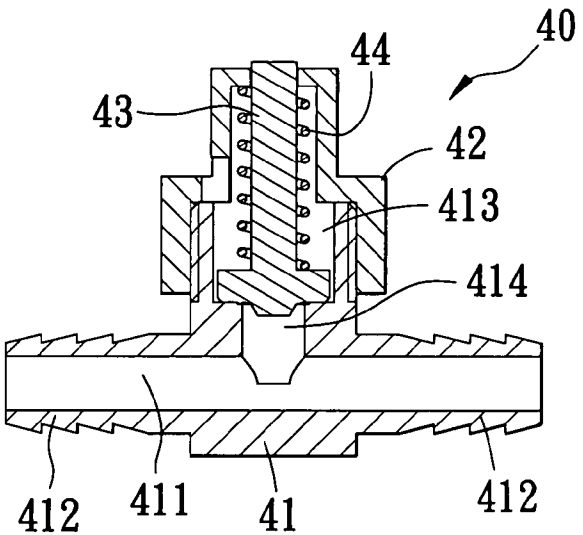
FIG. 9 is a cross-sectional view of the pressure releasing valve of the preferred embodiment of a pressure vessel in the present invention.
Figure 8:
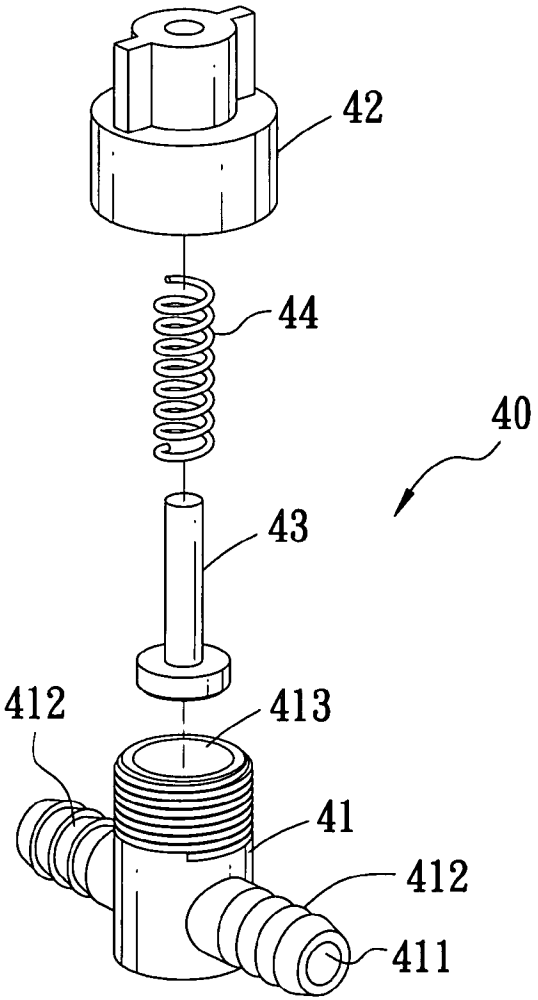
FIG. 8 is an exploded perspective view of a pressure releasing valve of the preferred embodiment of a pressure vessel in the present invention.

The pressure releasing valve 40, as shown in FIGS. 8 and 9, includes a valve base 41, a cover 42 screwed together with the valve base 41, a valve bar 43 installed inside the valve base 41 and reached to the cover 42, and a coil spring 44 worn on the valve rod 43 and leaned to the cover 42 with one end. The valve base 41 is provided with an inner passage having a tube connecter 421 at two ends respectively communicating with the pressure stabilizing valve 30 and the air entry valve 50 respectively. Also, the valve base 41 is provided with a groove 413 at the top having an opening 414 at the center communicating with the passage 411. The valve bar 43 is to be pushed by the coil spring 44 to seal on the top of the opening 414. When the water pressure of the pressure releasing valve 40 surpasses a preset pressure, able to overtake the force of the coil spring 44, it is to push upwards at the bottom of the valve rod 43 so as to keep the opening 414 disclosed.

Figure 11:
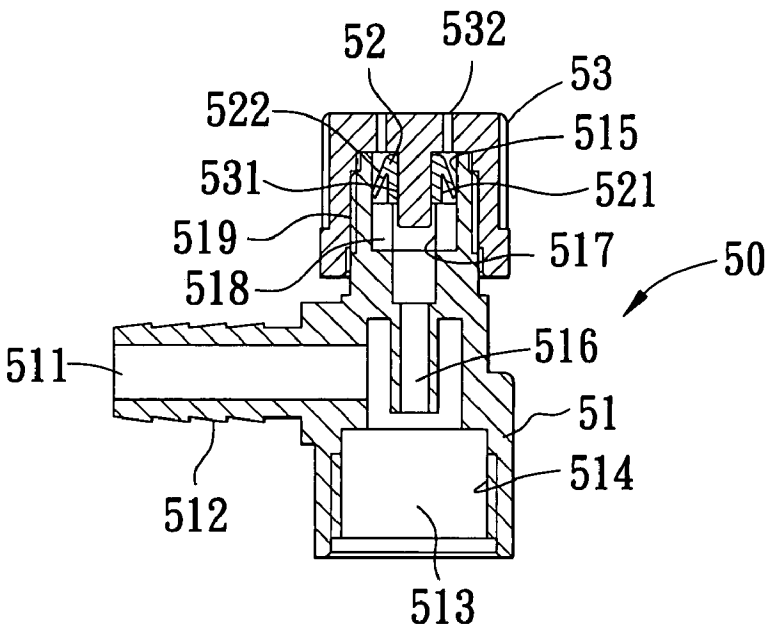
FIG. 11 is a cross-sectional view of the air entry valve of the preferred embodiment of a pressure vessel in the present invention.
Figure 10:
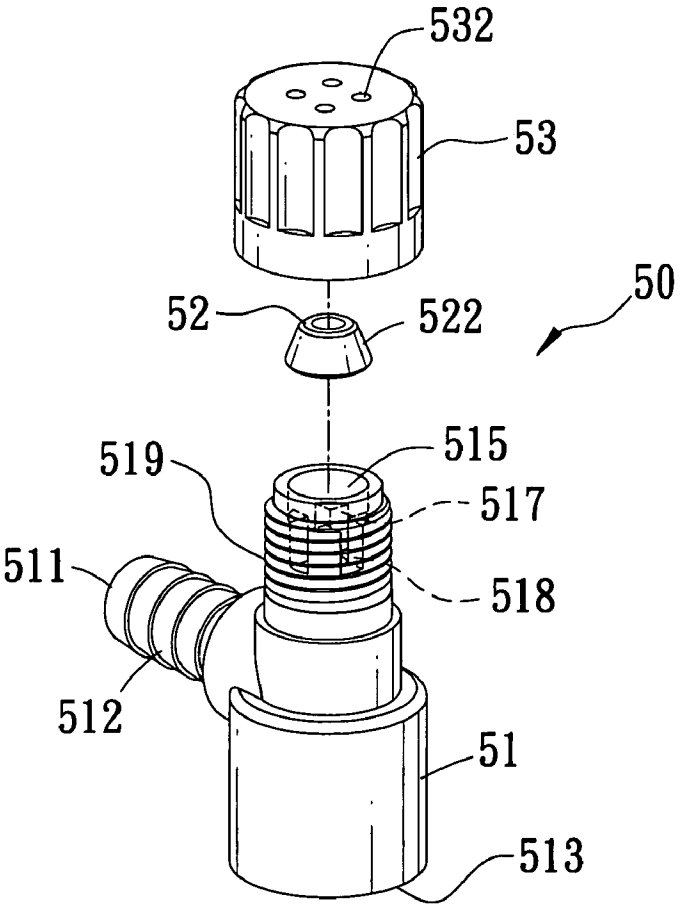
FIG. 10 is an exploded perspective view of an air entry valve of the preferred embodiment of a pressure vessel in the present invention.

The air entry valve 50, as shown in FIGS. 10 and 11, includes a valve body 51, a film plug 52 and an upper cover 53. The valve body 51 is provided with a tube connecter 512 having an entry 511 at a side wall, an exit 513 at the bottom provided with female threads 514 on an interior wall for screwing with the water entry 12 of the main vessel 10, an air vent 515 connected with an air passage 516 having a smaller diameter and communicating with both the entry 511 and the exit 513. Four ribs 517 are set integrally at the 15 bottom annular wall of the air vent 515, interspaced equidistantly. Every two of the ribs 517 adjacent are separated by an opening 518. In addition, the air vent 515 is provided with a threaded tube 519 on the exterior surface.

The film plug 52 is provided with an annular wall 521 installed inside the air vent 515 and fixed on the top of the ribs 517. Moreover, a conical film 522 extended outwards and obliquely from the annular top of the annular wall 521 is to elastically seal the interior wall of the air vent 515 under the normal condition.

The upper cover 53 screwed together with the threaded tube 519 is provided with a fixing bar 531 extended downwards from the central top, able to pass through the annular wall 521 of the film plug 52 to lean on the top of the film plug 52, and plural air holes 532 on the top wall. When the atmospheric pressure outside is bigger than that inside the valve body 51, a pressure difference is generated to enable the conical film 522 of the film plug 52 to shrink inwards so as to form an interval with the air vent 515, enabling the atmosphere to flow orderly through the air holes 532, the openings 518 between the ribs 517, and the air passage 516 into the valve body. 51 for mixing with water. The mixture of air and water is then to flow out from the exit 513 to run into the chamber 11 of the main vessel 10.

Figure 12:
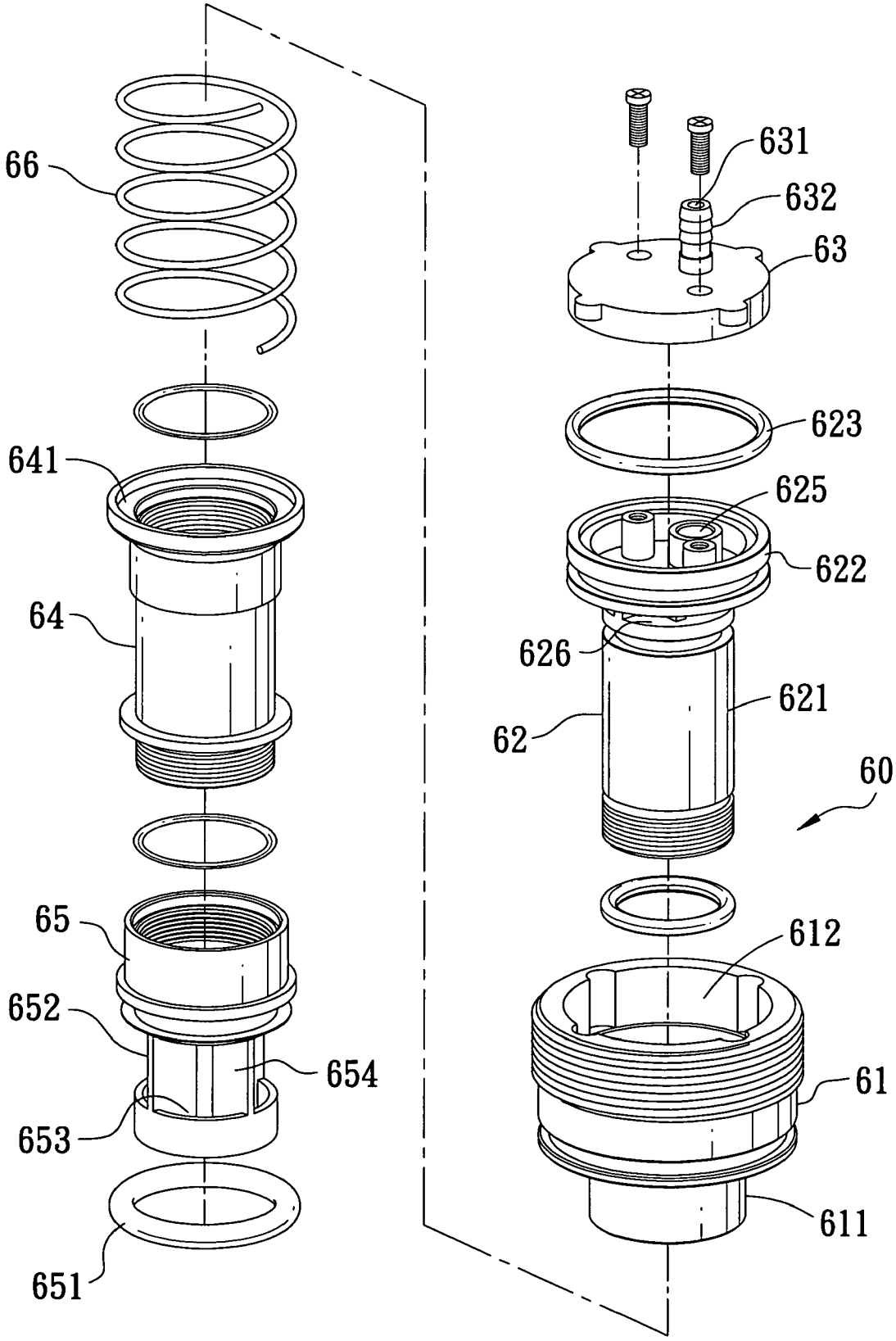
FIG. 12 is an exploded perspective view of a drain valve of the preferred embodiment of a pressure vessel in the present invention.
Figure 13:
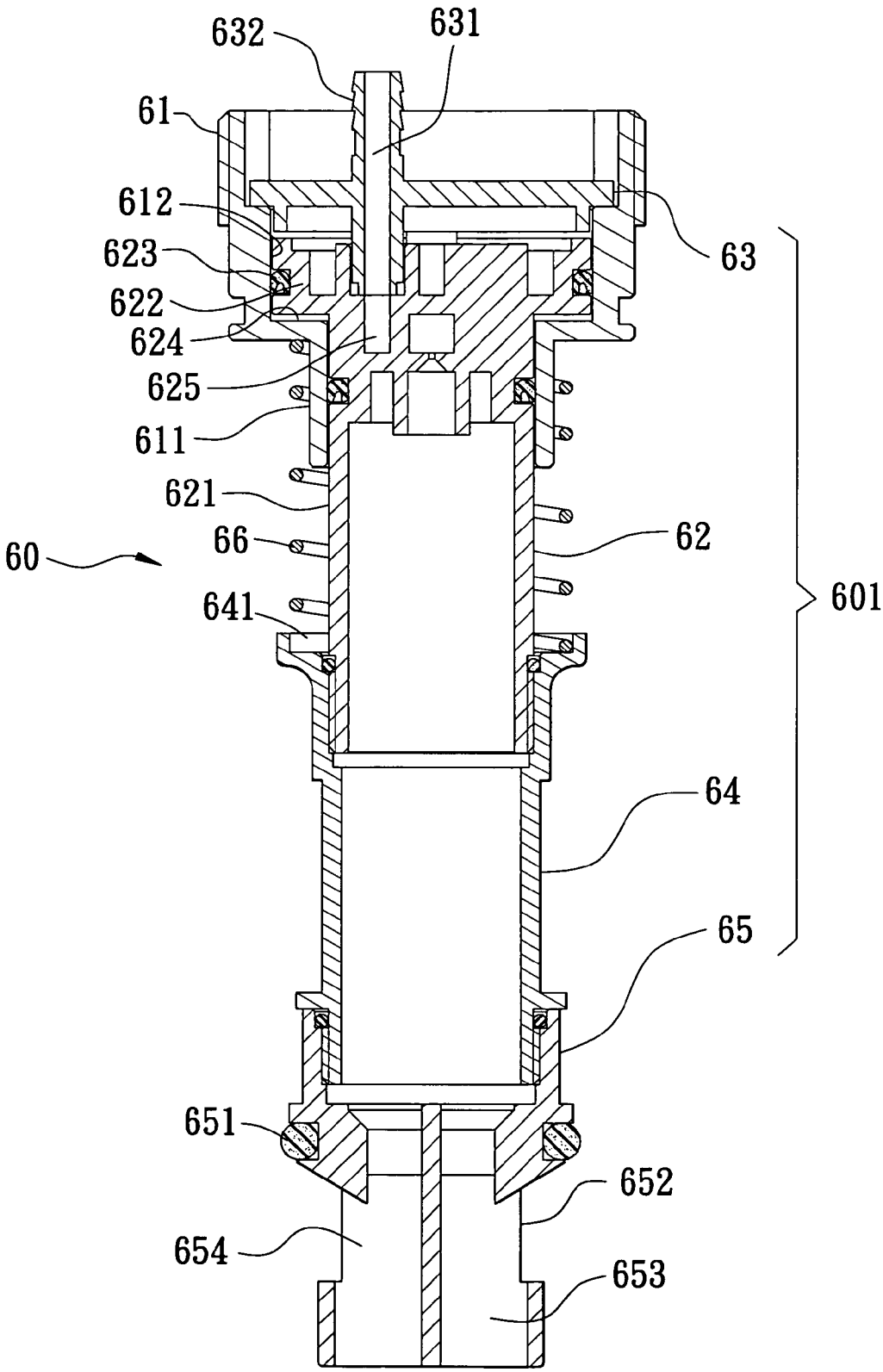
FIG. 13 is a cross-sectional view of the drain valve of the preferred embodiment of a pressure vessel in the present invention.

The drain valve 60, as shown in FIGS. 12 and 13, includes a valve base 61, a piston unit 601 and a spring 66. The valve base 61 screwed together with the opening 13 of the main vessel 10 at the top is provided with a shrunk tube 611 at the bottom, a groove 612 at the top and a penetrating groove 613 inside the groove 612 communicated with the bottom of the shrunk tube 611. The piston unit 601 includes a piston rod 62, a piston cover 63, a spring base 64 and a sealing base 65.

The piston rod 62 is provided with a rod part 621 at the bottom able to penetrate downwards through the penetrating groove 612 of the valve base 61, a piston part 622 at the top having a big diameter and fitted with a sealer 623 around the wall for preventing leaking. The sealer 623 is to be fitted in the interior wall of the groove 612 of the valve base 61, enabling a chamber 624 to be confined between the piston part 622 and the groove 612 of the valve base 61; in addition, the piston part 622 is provided with a first flowing passage 625 through the top, able to connect with the chamber 624 via plural openings 626 formed on the annular wall of the rod part 621.

The piston cover 63 fixed on the top of the piston part 622 is provided with a second flowing passage 631 on the top, having a tube connecter 632 at two ends respectively; the tube connecter 632 at the lower end of the second flowing passage 631 is to be fitted with the first flowing passage 625 of the piston rod 62 and the other is to be connected with the control valve 70, able to guide the pressured water from the control valve 70 into the chamber 624 so as to compress the piston part 622 upwards to keep the piston rod 62 moved upwards as well.

The spring base 64 formed cylindrical and fixed with the bottom of the rod part 621 is provided with a spring fixing groove 641 at the top. The sealing base 65 formed cylindrical and screwed together with the bottom of the spring base 64 is provided with a sealer 651 around a preset annular wall, able to seal the drain exit 15 of the main vessel 10 when the sealing base 65 is moved down for a preset distance, and plural separating ribs 652 shaped as a cross "+" inside it, able to divide the lower portion of the sealing base 65 into four grooves 653, Each of the grooves 653 is cut with an opening 654 at the portion under the sealer 651 so as to keep the drain exit 15 disclosed when the sealer 651 of the sealing base 65 is moved up together with the spring base 64, enabling the pressured water in the vessel 10 to flow out from the opening 654 of the sealing base 65 through grooves 653 to flush the toilet.

The spring 66 can be a compression spring, worn outside the shrunk tube 611 of the valve base 61 by the top and fitted in the spring fixing groove 641 of the spring base 64 by the bottom, enabling the spring base 64 to be pushed down, so the piston rod 62, the piston cover 63, and the sealing base 65 are therefore to be moved downwards together with the spring base 64, enabling the sealing base 65 to seals the drain exit 15 of the main vessel 10.

Figure 14:
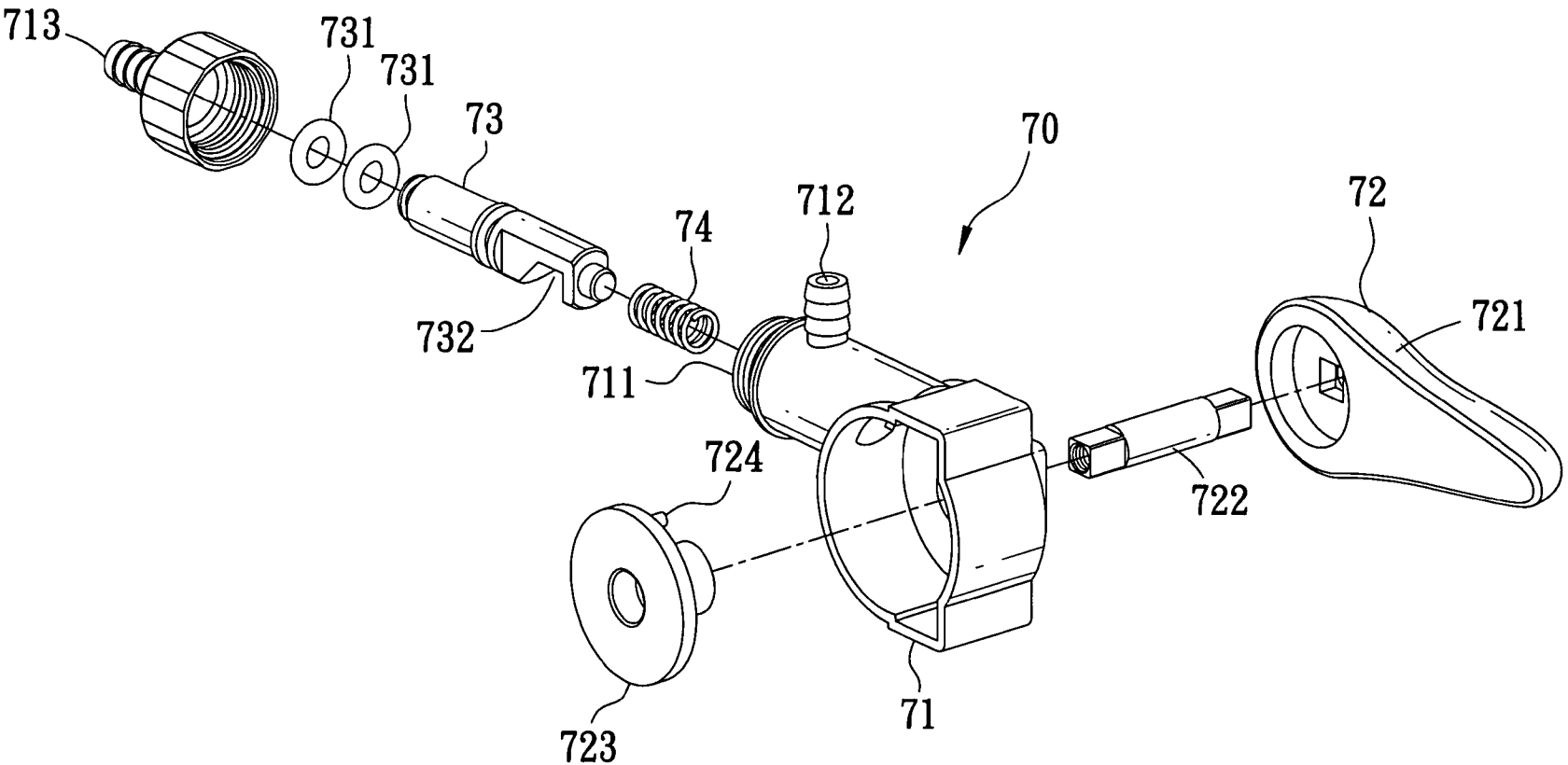
FIG. 14 is an exploded perspective view of a control valve of the preferred embodiment of a pressure vessel in the present invention.
Figure 15:
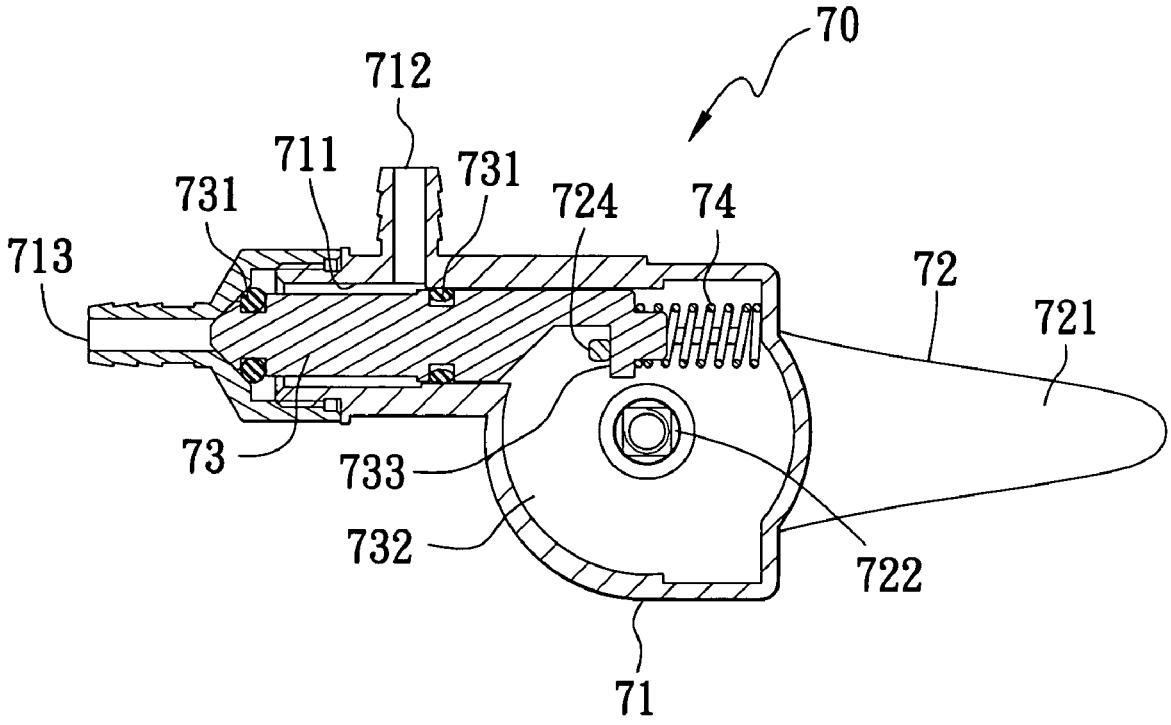
FIG. 15 is a cross-sectional view of the control valve of the preferred embodiment of a pressure vessel in the present invention.

The control valve 70, as shown in FIGS. 14 and 15, includes a valve body 71, a handle 72, a valve bar 73 and a spiral spring 74.

The valve body 71 is provided with a valve chamber 711 at one side, provided with an entry 712 at a side wall for connecting with the pressure releasing hole 14 of the main vessel 10 as seen in FIG. 2, and an exit 713 at the end for connecting with the second flowing passage 631 of the drain valve 60.

The handle member 72 is provided with a handle 721 fixed with one end of a shaft 722 that is fixed pivotally with the end of the valve body 71 opposite to the valve chamber 711, and a rotator 723 fixed with the shaft 722 and having an initiating bar 724 projected on the inner wall.

The valve bar 73 installed inside the valve chamber 711 is provided with a sealer 731 positioned respectively at the corresponding front and rear of the entry 712. The front sealer 731 is to isolate a portion of the valve chamber 711 communicating with the exit 713 and the rear one is to seal the interior wall of the valve chamber 711. The valve bar 73 is also provided with a groove 732 on the rear portion and a stopping wall 733 at the rear of the groove 732, able to pull back the valve bar 73 so as to keep the front sealer 731 moved away the entry 713 of the valve chamber 711 when it is forced properly by the initiating bar 724 of the rotator 723. Therefore, the pressured water in the vessel 10 can flow orderly through the entry 712 of the valve chamber 711, the spaces of the valve chamber 711, the exit 713 and the second flowing passage 631 of the drain valve 60 for actuating the piston unit 601.

The spiral spring 74, fixed between the rear of the valve rod 73 and the interior of the valve body 71, is able to push forwards the valve rod 73 to seal the entry 713 of the valve chamber 711, keeping the entry 713 closed under the normal condition.

Figure 16:
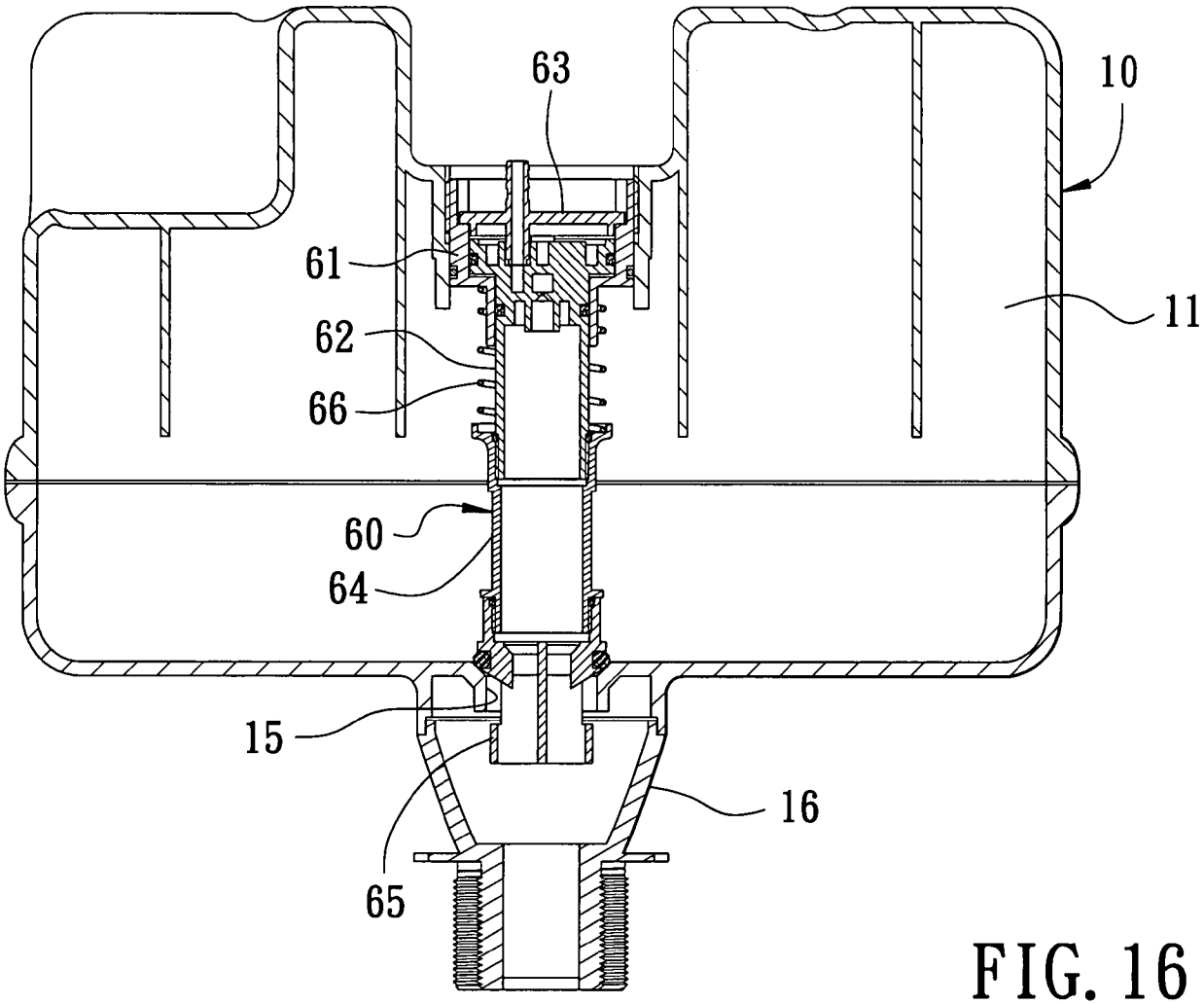
FIG. 16 is a cross-sectional view of the drain valve of the preferred embodiment of a pressure vessel in the present invention, showing it being sealed.
Figure 19:
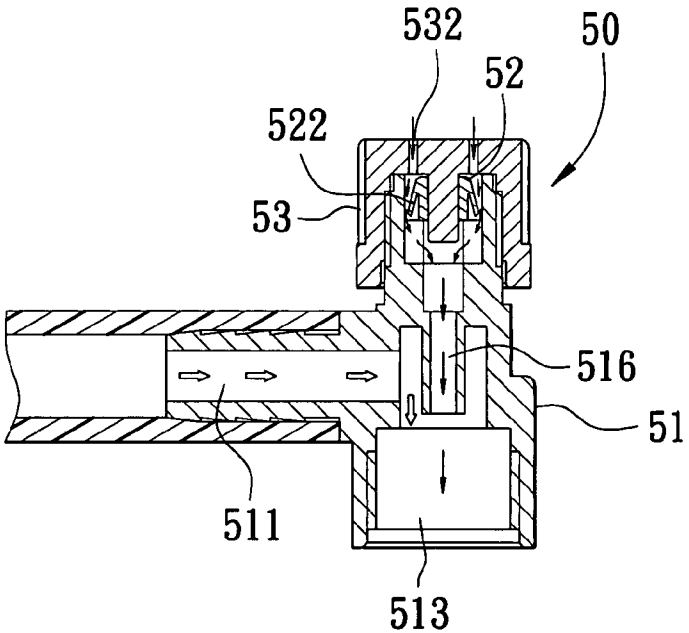
FIG. 19 is a cross-sectional view of the air entry valve of the preferred embodiment of a pressure vessel in the present invention, showing it sucking in the atmosphere.

In using, as shown in FIG. 2, at the very beginning when the present invention is used, the pressure in the main vessel 10 is still low, pressured water coming from a water supply system is to flow fluently from the entry 222 of the water entry valve 20 to the exit 213, and then, to the pressure stabilizing valve 30. By the time, when the pressured water flows in from the entry 313, the valve rod 34 of the pressure stabilizing valve 30 is forced by the compression spring 35 to become disclosed. So, the pressured water continue to flow through the chamber 311 to the exit 312 and then, to the pressure releasing valve 40. By the time, the pressured water is still in low pressure, therefore, it is to flow further through the passage 411 to the air entry valve 50 without producing release pressure. When the pressured water flows in from the entry 511 to pass through under the air passage 516 quickly, it can cause to form a vacuum under the air passage 516 to keep the conical film 522 of the film plug 52 pushed away by the atmosphere via the siphon theory. Then, as shown in FIG. 19, the atmosphere is to be sucked in from the air holes 532 of the upper cover 53 to mix with the pressured water to form an air/water mixture, flowing out from the exit 513 to the chamber 11 of the main vessel 10. By the time, as shown in FIG. 16, because the drain exit 15 of the main vessel 10 is sealed by the sealing base 65 of the drain valve 60, so, the pressured water can gradually flow and be stored in the chamber 11 of the main vessel 10.

As the air/water mixture runs into the main vessel 10 continuously, the pressure in the main vessel 10 is to gradually rise up. The water flow rate in the air entry valve 50 is to lessen gradually so as to reduce the extent of the vacuum in the air passage 516. When the pressure is transmitted to the film plug 52, the conical film 522 is to return to seal the air vent 515. But, the pressured water is to keep on flowing into the main vessel 10 until the pressure inside the main vessel 101 is balanced with that of the pressured water, reaching a preset pressure.

In addition, before the pressure of the main vessel 10 reaches the balanced pressure, some of the pressured water is to flow from the pressure releasing hole 14 to the control valve 70 and then, through the entry 712 to the spaces among the valve chamber 711. By the time, because the exit 713 of the valve chamber 711 is sealed by the valve rod 73, therefore, the control valve 70 is to have a higher pressure gradually when the pressure of the pressured water is rising up.

Figure 17:
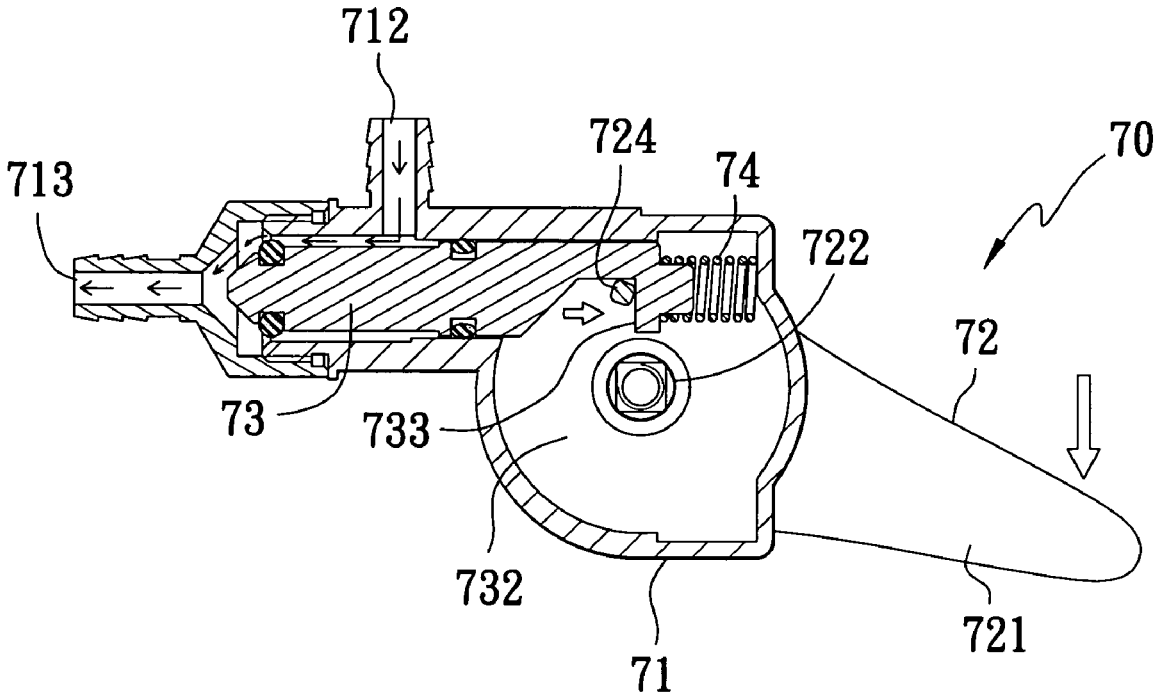
FIG. 17 is a cross-sectional view of the control valve of the preferred embodiment of a pressure vessel in the present invention, showing it being pressed down.
Figure 18:
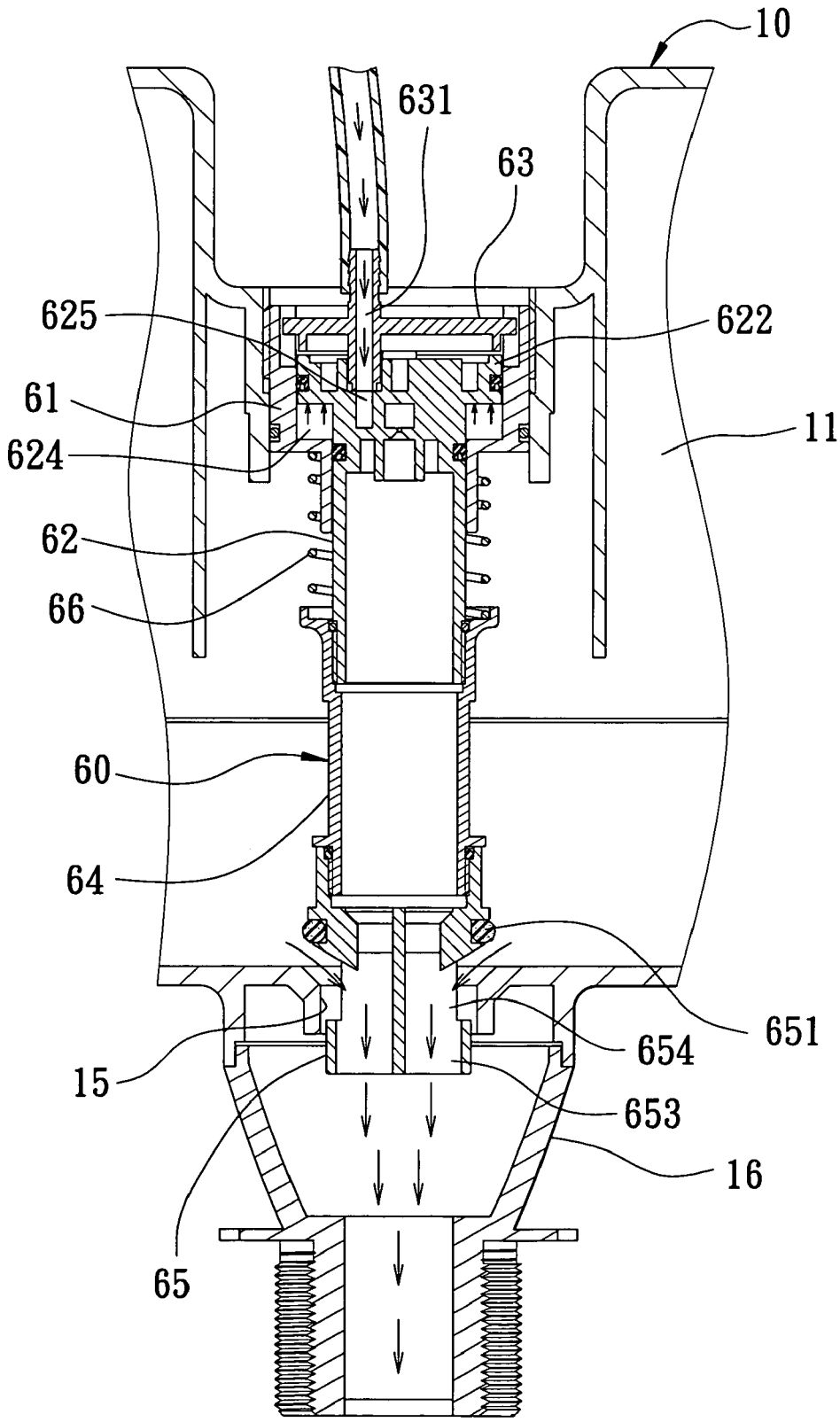
FIG. 18 is a cross-sectional view of the drain valve of the preferred embodiment of a pressure vessel in the present invention, showing it being opened for flushing down the pressured water.

As shown in FIG. 17, when the present invention is to be operated to flush down, the handle 72 of the control valve 70 has to be moved along a preset direction first to make the rotator 723 whirled, so that the valve rod 73 can be pulled back by the initiating bar 724 of the rotator 723 so as to move away the exit 713, enabling the pressured water stored to flow from the exit 713 to the second flowing passage 631. Then, the pressured water flows through the first flowing passage 625, the opening 626 to the chamber 624 so as to push up the piston part 622 of the piston rod 62 and simultaneously, enable the sealing base 65 to move up and separate from the drain exit 15 of the main vessel 10. Next, with reference to FIG. 18, the pressured water in the chamber 11 of the main vessel 10 can flow out from the openings 654 and then, be rectified by the grooves 653 to rush into the toilet, achieving an excellent flushing.

Figure 20:
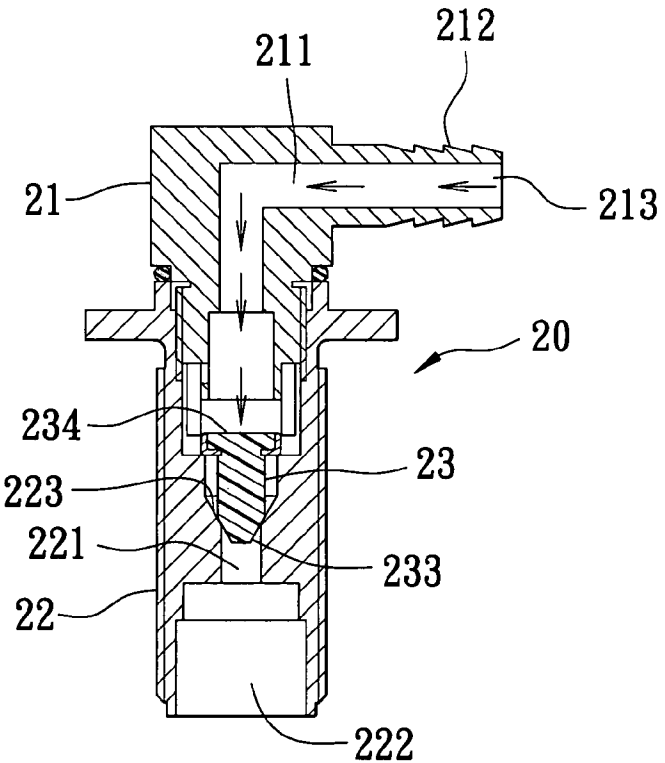
FIG. 20 is a cross-sectional view of the water entry valve of the preferred embodiment of a pressure vessel in the present invention, showing it preventing the pressured water from flowing adversely.

Moreover, if the pressure in the main vessel 10 surpasses a preset one, the pressure releasing valve 40 is to be informed to enable the valve rod 43 to move up for releasing pressure, assuring a safety use. By the time, the overflowed water generated while releasing pressure is to flow to the area between the interior of the vessel and the exterior of the main vessel 10, and then, flow through the overflow holes 172 of the cover 171 to push the one-way stopper 173 for dropping into the toilet, never storing in the vessel or overflowing outside. And, if the pressured water coming from the water supply system has a lower pressure, the pressured water may flow adversely back to the water entry valve 20 through the exit 213; by the time, the pressured water is to force on the flat surface 234 of the movable valve rod 23 to push down the movable valve bar 23 so as to enable the conical member 233 to seal the funnel hole 223, keeping the entry 222 closed automatically for preventing a reverse flow possible to contaminate the supply-system water, as shown in FIG. 20.

The present invention has following advantages as can be seen from the foresaid description.

1. The drain valve 60, based on guiding water pressure to force the piston bar 62 to move upwards for opening it, has a simpler structure than that of a conventional one using the pressure inside the drain valve to open a piston for releasing pressure. The present invention can also omit parts like a pressure releasing tube and a controlling device, achieving a quick assembly and a lower cost of manufacturing.

2. The control valve 70 based on a handle member 72, using a handle 721 to control a valve rod 73 by rotating the rotator 723, saves more force than that of a conventional one merely by means of a pressing does while operating.

3. The sealing base 65 at the bottom of the drain valve 60 is divided by the separating ribs 652 into four grooves 653 that are able to rectify the pressured water coming from the openings 654 to prevent a turbulent flow, obtaining an effective flushing.

4. Because the drain exit 15 is opened via pushing upwards the piston bar 73 with the pressured water coming from the control valve 70 and entering into the drain valve 60, therefore, it is not to open automatically if the control valve 70 or its relative connecting tube is out of order or leaking, able to prevent water from wasted.

5. The drain exit 15 of the main vessel 10 will be sealed immediately by the sealing base 65

6. When a flushing action is completed at the drain valve 60, the coil spring 66 is to immediately rebound to push the sealing base 65 to seal the drain exit 15 of the main vessel 10, and therefore, the supply-system water is able to flow into the water entry valve 20 for refill the main vessel 10. So, the invention can refill the main vessel in a short time, convenient for consecutive using.

While the preferred embodiment of the invention has been described above, it will be recognized and understood that various modifications may be made therein and the appended claims are intended to cover all such modifications that may fall within the spirit and scope of the invention.

What is claimed is:

1. A pressure vessel comprising:

a main vessel provided with a chamber for containing pressured water, a water entry, an opening and a pressure releasing hole at the top, and a drain exit at the bottom for releasing pressured water;

an air entry valve able to let a mixture of the atmosphere and the pressured water flow from said water entry into said chamber of said main vessel;

a water entry valve able to transmit pressured water to said air entry valve and prevent it from flowing reversely;

a drain valve provided with a valve base, a piston unit and a spring, said valve base fixed at said opening of said pressure vessel; said piston unit inserted fixedly inside said valve base, the space between said piston unit and said valve base formed as a chamber; said spring fixed between said valve base and said piston unit and able to push down said piston unit by means of its elasticity so as to seal said drain exit of said main vessel, said chamber able to let pressured water flow in to force said piston unit to move up and to separate from said drain exit, enabling said drain exit to become disclosed; and a control valve able to store the pressured water coming from said pressure releasing hole of said main vessel and to control the pressured water to flow into said chamber of said drain valve;

said drain exit of said main vessel is connected with a threaded base at the bottom, provided with an opening at a sidewall having an overflow valve able to close said opening in one way; and said overflow valve is provided with a cover, having plural overflow holes on the surface, able to close said opening of said threaded base, and a one-way stopper pivotally fixed at said opening able to prevent water from flowing out of said overflow holes and permit water flow inwards through them.

2. The pressure vessel as claimed in claim 1, wherein a pressure stabilizing valve is connected between said water entry valve and said air entry valve for stopping the pressured water if the pressured water has a pressure larger than a preset one.

3. The pressure vessel as claimed in claim 2, wherein said pressure stabilizing valve comprises:

a front valve body provided with a chamber having an exit communicating with said air entry valve at one end and an entry communicating with said water entry valve at a sidewall;

a rear valve body fixed with the rear of said front valve body;

a rear valve cover sealed at the end of said rear valve body;

a valve bar installed inside said front valve body and said rear valve body, and able to properly close said exit of said front valve body by the front end; and a compression spring installed between the end of said valve rod and said rear valve body, able to move back said valve rod to separate from said exit of said front valve body, keeping said exit of said front valve body disclosed under the normal condition.

4. The pressure vessel as claimed in claim 2, wherein a pressure releasing valve is connected between said pressure stabilizing valve and said air entry valve, able to open for releasing water if water pressure surpasses a preset one.

5. The pressure vessel as claimed in claim 1, wherein said water entry valve comprises:

an upper valve;

a lower valve fixed with the bottom of said upper valve and provided with an inner path in the center; and a movable valve rod installed inside said upper valve and said lower valve, and provided with a conical member at the end for sealing properly the upper end of said inner path of said lower valve and a flat surface at the top for pressured water to act on while flowing reversely.

6. The pressure vessel as claimed in claim 5, wherein said movable valve rod is made of plastic integrally and said flat surface is wrapped with a layer of metal.

7. The pressure vessel as claimed in claim 1, wherein said air entry valve comprises:

a valve body provided with an entry, an exit and an air vent communicating with one another;

a film plug set inside said air vent and provided with a conical film annularly able to seal inside said air vent and be shrunk by the pressure difference of the two sides to form a space with the wall of said air vent; and an upper cover fixed on said air vent of said valve body and provided with an air hole on the top for sucking atmosphere through the space of said conical film into said valve body and then, through said exit to said chamber of said main vessel.

8. The pressure vessel as claimed in claim 7, wherein said air vent of said valve body is provided with an air passage with a small diameter at the center and four ribs formed integrally but interspaced equidistantly from the bottom annular wall of said air vent; every two of said ribs adjacent separated by an opening; the atmosphere coming through the space of said conical film able to pass through said openings and said air passage into said valve body.

9. The pressure vessel as claimed in claim 1, wherein said control valve comprises:

a valve body provided with an valve chamber at one side, an entry at a sidewall of said valve chamber for pressured water to flow in and connected to said chamber of said main vessel, and an exit at the end of said valve chamber for connecting to said drain valve;

a valve rod installed movably inside said chamber and provided with a compression spring set between the rear end and the corresponding interior wall of said valve body, said compression spring able to push forwards said valve rod to seal said exit of said valve body; and a handle member fixed pivotally at the end of said valve body opposite to said exit and able to be rotated to pull back said valve rod for separating from said exit of said valve rod.

10. The pressure vessel as claimed in claim 9, wherein said handle member comprises:

a handle;

a shaft fixed pivotally at one side of said valve body opposite to said exit by one end and fixed with said handle by the other end; and a rotator fixed with said shaft and provided with an initiating bar projected on the inner wall able to pull back said valve rod for separating from said exit of said valve rod.

11. The pressure vessel as claimed in claim 1, wherein said spring of said drain valve is a compression spring.

12. The pressure vessel as claimed in claim 1, wherein said piston unit of said drain valve comprises:

a piston rod provided with a bar part at the bottom piercing through said valve base, a piston part at the top having a large diameter and inserted inside said valve body, a chamber located between the bottom and the interior of said valve base, a first flowing passage piercing through inside said piston part and at least an opening set at the top annular wall and able to keep said first flowing passage connected with said chamber;

a piston cover fixed with the top of said piston part and provided with a second flowing passage communicating with said control valve by one end and with the top of said first flowing passage of said piston part, able to guide the pressured water to flow through said first flowing passage into said chamber;

a coil spring base fixed with the bottom of said bar part of said piston rod;

a compression spring worn on said piston rod, limited between said valve base and said spring base and able to push down said spring and said piston rod; and a cylindrical sealing base fixed with the bottom of said spring base and provided with a sealer fitted at a preset annular wall for sealing said exit of said main vessel properly.

13. The pressure vessel as claimed in claim 12, wherein said sealing base is provided with separating ribs shaped as a cross "+" inside it, able to divide the lower portion of said sealing base into four grooves; each said groove located below said sealer and cut with an opening at a preset position of the side wall.

14. The pressure vessel as claimed in claim 12, wherein said sealer is an anti-leaking washer.

* * * * *